United States Patent [19]

Miller

[11] 4,181,336

[45] Jan. 1, 1980

[54] HOPPER CAR CAM LOCK DOOR OPERATING MECHANISM

[75] Inventor: Roy W. Miller, Highland, Ind.

[73] Assignee: Pullman Incorporated, Chicago, Ill.

[21] Appl. No.: 859,066

[22] Filed: Dec. 9, 1977

[51] Int. Cl.[2] ..... E05C 17/18

[52] U.S. Cl. ..... 292/262; 292/DIG. 32; 105/251; 105/255; 298/37

[58] Field of Search ..... 292/53, 56, 262, 338, 292/267, 278, 221, DIG. 32; 105/251

[56] References Cited

U.S. PATENT DOCUMENTS

| | | | |
|---|---|---|---|
| 1,595,555 | 8/1926 | Kooser | 292/267 |
| 1,700,557 | 1/1929 | Cherniack et al. | 292/53 X |
| 2,369,725 | 2/1945 | Dyrr | 292/266 X |
| 2,388,075 | 10/1945 | Peters | 292/267 |
| 2,534,626 | 12/1950 | Rubenstein | 292/267 X |
| 2,692,788 | 10/1954 | Willis | 292/274 X |
| 2,702,205 | 2/1955 | Germain | 292/278 X |
| 2,901,985 | 9/1959 | Dorey | 292/238 X |
| 3,710,730 | 1/1973 | Austgen et al. | 105/251 X |
| 3,885,846 | 5/1975 | Chuang et al. | 292/266 X |

FOREIGN PATENT DOCUMENTS

| | | | |
|---|---|---|---|
| 717910 | 10/1931 | France | 292/53 |

*Primary Examiner*—Richard E. Moore
*Attorney, Agent, or Firm*—Richard J. Myers

[57] ABSTRACT

A door lock mechanism for hopper cars includes a longitudinally extending operating rod actuated by a linkage means tripped by a track side cam. The rod in turn actuates cam locks by means of bell cranks which cause the locks to rotate and release transverse tension rods connected to doors for opening the same. The cam locks include cams engageable with teeth on the tension rods for securely locking the doors in a closed position. The operating rod also includes cam means effectively engaging the cam locks to positively lock the same in a closed position.

10 Claims, 6 Drawing Figures

FIG. 3
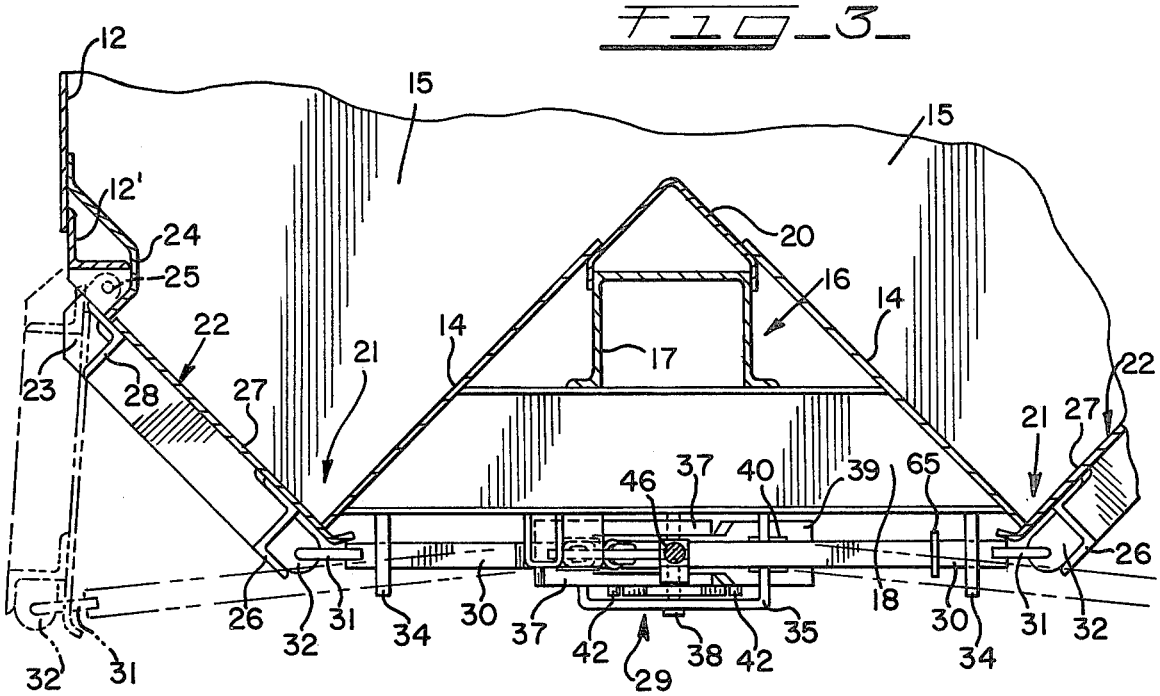
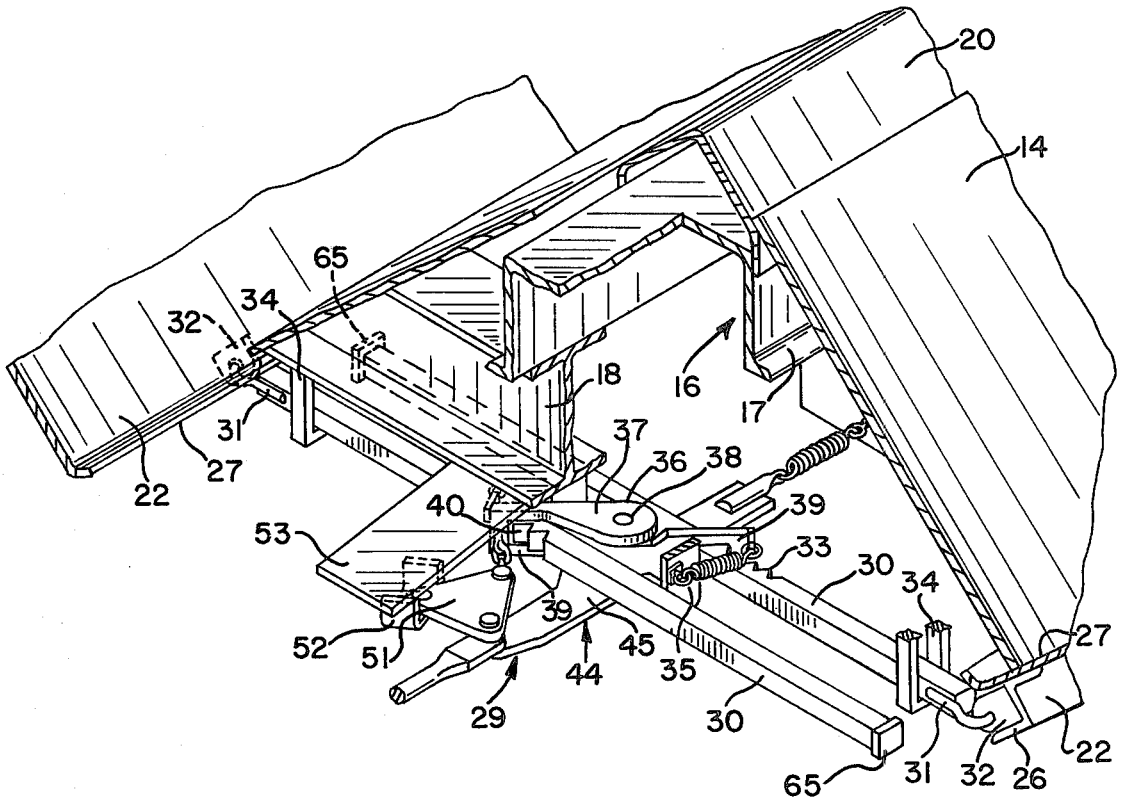
FIG. 4

HOPPER CAR CAM LOCK DOOR OPERATING MECHANISM

BACKGROUND OF THE INVENTION

1. Field of the Invention

The present invention relates to railway hopper cars and more specifically to operating mechanisms for locking and unlocking the side discharge doors of a hopper.

2. Description of the Prior Art

Patents pertinent to the present invention are U.S. Pat. No. 2,369,725, Feb. 20, 1945; U.S. Pat. No. 2,388,075, Oct. 30, 1945; U.S. Pat. No. 2,534,626, Dec. 19, 1950; U.S. Pat. No. 2,692,788, Oct. 26, 1954; and U.S. Pat. No. 3,885,846, May 27, 1975. The present invention is an improvement over the aforementioned patents.

SUMMARY OF THE INVENTION

The present door lock mechanism is particularly suitable for use on center sill side dump hopper cars with longitudinal doors. The doors are located on opposite sides of the car and can be closed with respect to the discharge openings from which material is dumped outwardly from a pair of hoppers supported on the car. In the preferred embodiment, two longitudinally disposed hoppers each include two sets of side operating doors which are actuated for release by the present invention. The lock mechanism consists of a center longitudinal actuating member or operating rod that is supported along the center line of the car on the car underframe. The operating rod or actuating member is attached to a suitable linkage mechanism at one end of the car near one of the car trucks. This linkage mechanism is designed to engage a cam device located between the rails or adjacent thereto which induces a pulling action on the actuating member as the car moves along the track. The other end of the actuating member is secured to a spring device to assure that the rod will return to its original position after opening of the side discharge doors in response to the track mounted cam device.

In the present invention the actuating member or operating rod is attached to four cam lock mechanisms which are supported on the underframe and each pair of doors includes two of these cam lock mechanisms. Each cam lock mechanism consists of a bell crank which transfers the longitudinal pull of the actuating member to the cam locks which are pivoted on the center line of the car and secured to the underframe by means of brackets. Each pair of the doors has connected thereto, four transversely extending tension members or transverse tension rods which pass through the cam locks and are disposed in longitudinally spaced relation. Each of the cam locks includes cam members or engageable portions which engage teeth provided on the tension rods to fixedly secure the rods in locking engagement with the cam locks when the doors are in the closed position. The outer ends of the tension rods include ring straps that pass through a ring connection that is fixedly secured to each discharge door and thus provides a somewhat universal connection between the operating tension rods and the doors. The opposite ends of the tension rod have stop plates to prevent accidental separation from the cam locks. The transverse tension rods are of sufficient length to allow full swing of the doors without the rods leaving the cam locks.

The connection between each of the bell cranks and the cam locks is a flexible chain which pulls the locks open during the operation of the longitudinal operating rod but permits the locks to be reset while the tension rods and discharge doors are in the open position. Suitable spring means at one end of the car are connected to the longitudinal operating rod which continually urges it to the locked position. The portion of the operating rod or actuating member that passes over the cam lock consists of a flat strap with a slot that guides the strap over the cam lock pivot. On each side of the flat strap are protruding bosses or cams that engage pins on the cam lock when in the closed and locked positions. These bosses or cams prevent accidental release of the cam locks while the car is in route to its destination.

BRIEF DESCRIPTION OF THE DRAWINGS

FIG. 3 is a cross-sectional view taken substantially along the line 3—3 of FIG. 2;

FIG. 4 is a perspective view of a portion of the railway car and door operating mechanism;

DESCRIPTION OF THE PREFERRED EMBODIMENT

Figure 1:
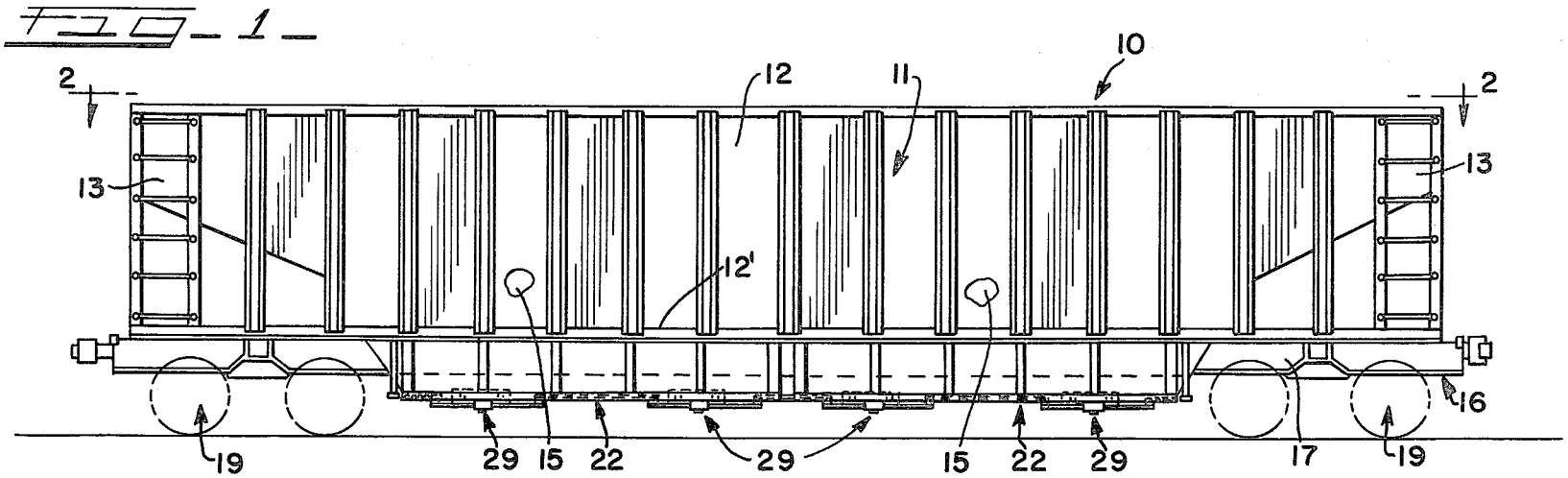
FIG. 1 is a side elevational view of a railway hopper car having an improved door operating mechanism.

The railway hopper car 10 includes a car body 11, side walls 12 and end walls 13. The side walls 12 include longitudinally extending side sills 12'. The hopper car 10 includes a pair of hoppers 15, which each includes side slope sheets 14, adapted to direct material downwardly and outwardly of the hoppers 15.

The hopper car 10 includes a conventional underframe 16 comprising a center sill 17 and cross bearer supports 18 spaced suitably along the length of the car 10. Wheel trucks 19 support the car 10 on suitable railway tracks. Each of the hoppers include an inverted V-shaped longitudinal cap 20 at the upper ends of the downwardly diverging slope sheets 14. Slope sheets 14 terminate in a discharge opening 21 for directing material sideways outwardly from the hopper car. Each hopper includes a pair of discharge doors 22 for closing each discharge opening 21. The discharge doors 22 are provided at their upper ends with hinge brackets 23 which are suitably connected to hinge brackets 24 supported on the side sill 12' by means of hinge pivots 25. Each of the doors 22 includes a lower Z-shaped longitudinally extended support angle 26 which is connected to door panels or plates 27. The hinge ends of the doors 22 are also supported by means of longitudinal reinforcing angles 28.

Figure 6:
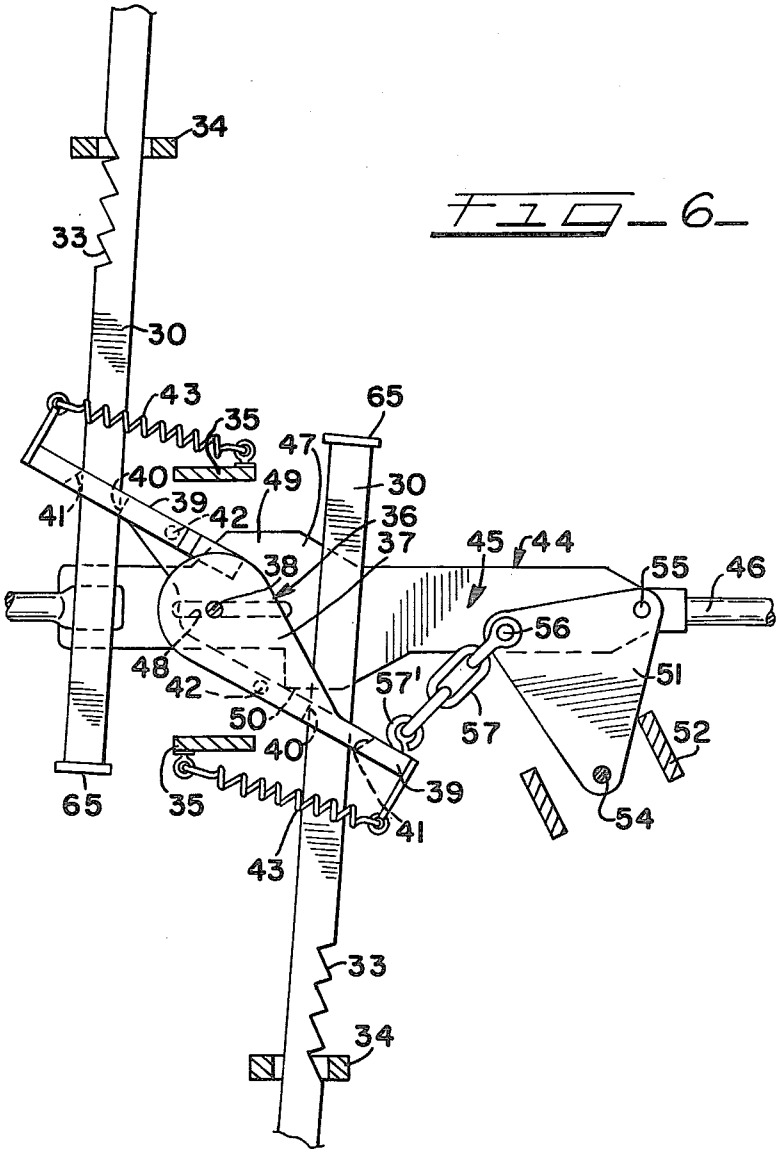
FIG. 6 is a view similar to FIG. 5 showing the door operating mechanism and cam lock arrangement in an open position.
Figure 5:
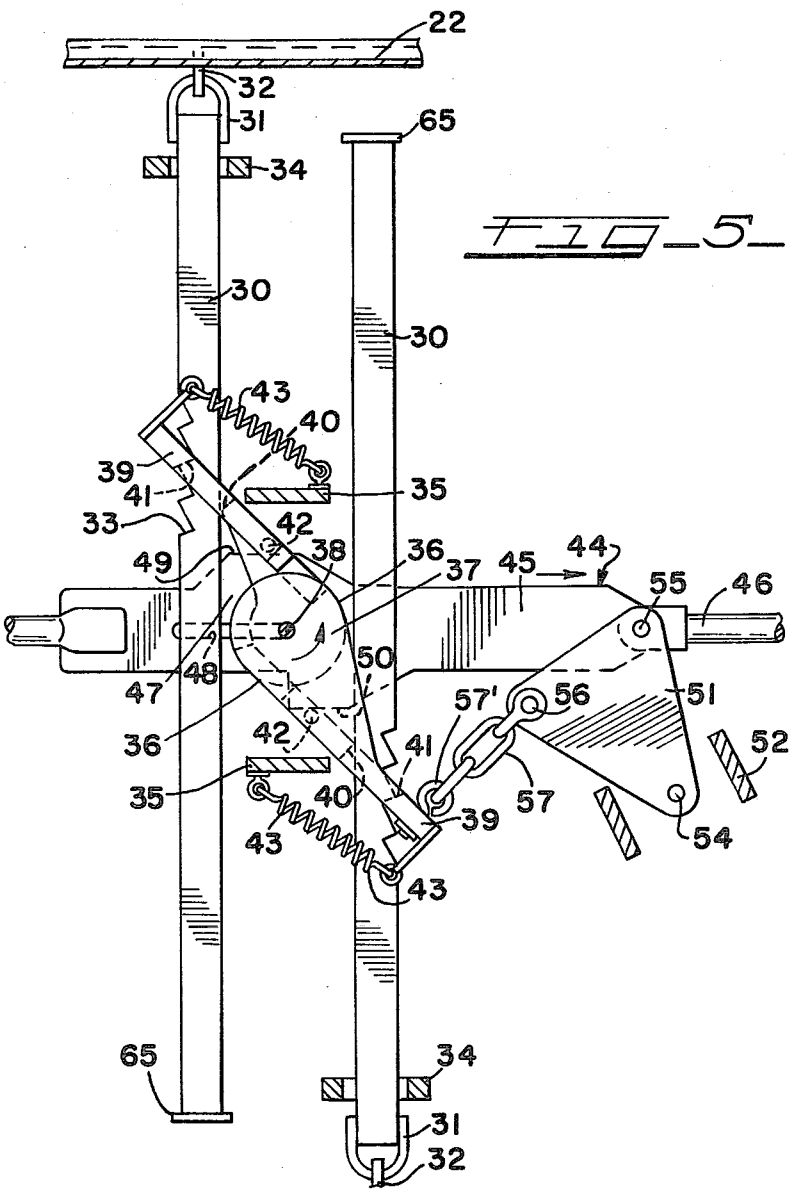
FIG. 5 is a detailed plan view of a cam lock mechanism and its operating relation to the side doors of the car.

As best shown in FIGS. 3, 4, 5 and 6, door operating mechanisms 29 are provided for each of the doors 22. Each oppositely opening pair of doors 22 is provided with two operating mechanisms 29. Each mechanism 29 includes a pair of longitudinally spaced tension rods 30 which extend transversely of the car in opposite directions. Each tension rod 30 is connected to a door by means of a ring strap 31 provided on the rod and engaging a ring 32 connected to the door 22. Each of the rods is provided with a number of teeth or serrations 33 spaced longitudinally along the rod. Each of the rods 30 is suitably supported on a guide 34 which extends downwardly from the cross bearer supports 18. As best shown in FIGS. 3 & 4, suitably spaced U-shaped brackets 35 are also connected to the underneath side of cross bearer supports 18 along the centerline of car 10. Each of the operating mechanisms 29 comprises a cam lock 36 consisting of upper and lower spaced plate members 37. Each cam lock 36 includes a pivot pin 38 which, as best shown in FIG. 3, is suitably supported on the U-shaped bracket 35. The cam lock 36 includes vertical cam elements or plates 39 which project outwardly in opposite directions. Each cam element 39 is provided with an opening 40 through which the tension rods 30 extend and slide. The openings 40 provide cam surfaces or teeth-engaging portions 41 which, as best shown in FIG. 5, securely engage the serrations 33 of tension rods 30 to firmly lock the doors 22 in the closed position. The cam elements 39 also include downwardly projecting lock pins 42, as best shown in FIGS. 3, 5, and 6. The ends of the cam elements 39 have suitably connected thereto springs 43, which in turn are anchored on the U-shaped bracket 35 to constantly urge cam lock 36 to the position shown in FIG. 5 wherein the tension rods 30 may be engaged and locked in position. Each of the tension rods 30 has at its inward end a stop plate 65 to prevent over-extension of the rods 30 relative to the cam locks 36.

Figure 2:
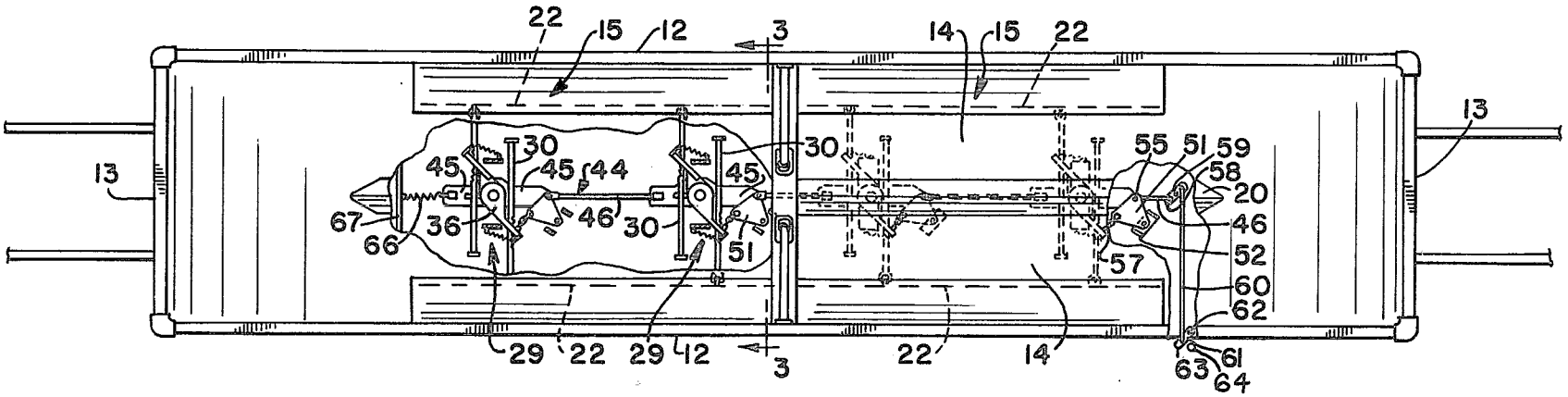
FIG. 2 is a plan view of the railway car of FIG. 1 showing portions of the hoppers broken away to illustrate the invention.

A longitudinal actuating member or operating rod 44, as best shown in FIG. 2, is positioned below the car body. The longitudinal actuating member 44 comprises a plurality of spaced plates 45, each in the region of a cam lock 36, and includes a plurality of interconnecting links 46 pivotedly connected to the plates 45. As best shown in FIGS. 5 and 6, each of the plates 45 includes a flat head portion 47 provided with a slot 48 through which the pin 38 extends and permits longitudinal movement of the actuating member 44 relative to each of the cam locks 36. The flat head portion 47 also includes on opposite sides thereof, bosses or cams 49 and 50 which, as indicated in FIG. 5, are in engagement with the lock pins 42 to prevent rotation and disengagement of the cam locks 36.

Each of the cam locks 36 is actuated by means of a bell crank 51, as best shown in FIGS. 5 and 6. As best shown in FIG. 4, each bell crank 51 is pivotally secured by pin 54 to the car body by means of a bracket 52 and a support plate 53, in turn connected to the cross bearer support 18. As shown in FIGS. 5 and 6, a pivot pin 55 connects each bell crank 51 to a link 46 and a pivot connection 56 connects a chain 57 to the bell crank 51. The chain 57 is connected by means of a ring 57′ to one of the cam elements 39 of each of the cam locks 36.

Referring now to FIG. 2, the bell crank 51 at one end of the car is connected to the link 46 which in turn is connected to a lever 58 suitably supported on the underneath side of the car by means of a vertical pivot 59. The lever 58 is rotated about the pivot 59 by means of a transverse link 60 which in turn is connected to a cam lever 61 suitably supported for pivotal movement about a vertical axis as indicated by pivot member 62 supported on the car body. Thus, movement of the link 60 in response to rotation of the cam lever 61 provides for tension movement of the link 46 to actuate the end bell crank 51, in turn providing for longitudinal movement of the longitudinal actuating member 44. Cam lever 61 includes cam engaging surface 63. A cam 64 is positioned suitably beneath the car adjacent to the track and operatively engages cam engaging surface 63 of cam lever 61 as the car passes along the track, whereupon the material within the car is dumped.

Referring again to FIG. 2, the other end of the longitudinal actuating member 44 has one of its flat plate portions 45 suitably connected to a spring 66, in turn anchored on a transverse member 67 suitably supported on the underneath side of the car, the said spring 66 continually urging the plate 45 and actuating member 44 to a position wherein the cam locks 36 are in their locked position as shown in FIGS. 2 and 5.

THE OPERATION

As best shown in FIGS. 2, 3, and 5, the doors 22 of the car 10 are in a closed and locked position during transit. In this position, the tension rods 30 are in fixed engagement with the cam locks 36 in that the serrations or teeth 33 are firmly engaged by the cam elements 39, the teeth-engaging portions 41 preventing outward movement of the tension rods 30. The actuating member 44 is indicated as having the right ends of its slots 48 in fixed engagement with the pins 38 since the actuating member 44 is urged into this position by means of the spring 66 connected to the cross member 67. In this position, it is noted that the lock pins 42 are in an engagement with the sides of the cams or bosses 49 and 50 so that rotation of the cam locks 36 is not possible and the rods 30 are firmly locked against outward movement.

As the car now passes in the region of the cam 64, cam engaging surface 63 of cam lever 61 engages the cam 64 pushing the link 60 transversely which pivots the lever 58, thereupon pivoting the end bell crank 51 in clockwise direction. As the end bell crank 51 pivots, the links 46 of actuating member 44 are moved to the right, in turn causing the other bell cranks 51 to pivot and pull on the chains 57, in turn pivoting the cam locks 36. As best shown in FIGS. 5 and 6, the flat heads 47 are moved to the right and the cams 49 and 50 are displaced to one side of the lock pins 42, allowing the cam locks 36 to pivot in a counter-clockwise direction. Teeth-engaging portions 41 are moved out of engagement with serrations 33 of tension rods 30 so that the weight of the material on the doors 22 moves the tension rods 30 outwardly, and the doors 22 are easily swung to an open position. In the event of mishap during this movement, the ends of the tension rods 30 are provided with stop plates 65 so that the doors 22 are limited in their outward movement. The open position of the tension rods 30 and the cam locks 36 is shown in FIG. 6.

After the load has been dumped, vehicle operators on the side of the roadbed, or suitable door closing devices, merely swing the doors 22 back to their closed position. As the doors 22 swing inwardly the rods 30 move transversely inward. As the serrations 33 of tension rods 30 move in through the openings 40, they become engaged by means of teeth-engaging portions 41 and again are locked firmly in the position shown in FIG. 5. By virtue of the flexible connection 57 of the bell cranks 51 to the cam locks 36 the cam locks are free now to achieve the aforementioned locked position. Locking engagement is assured since springs 66 and 43 continually urge actuating member 40 and cam locks 36 to their locked position, and the hopper car is again ready for transport to another destination.

What is claimed:

1. For a railway hopper car having a car body, an underframe, a hopper structure including discharge openings, and downwardly and laterally outwardly movable discharge doors connected to said body at laterally opposite sides thereof, for opening and closing said discharge openings, the improvement of a door operating mechanism comprising;

a tension rod connected to each door, said rods extending laterally inwardly and being spaced relatively longitudinally, a cam lock supported on said car for pivotal movement about a vertical axis, said cam lock including cam elements engageable with an inner portion of said tension rods in one pivotal position for locking said doors in a closed position, said cam lock elements in a second pivotal position releasing said doors for outward swinging movement and engaging said tension bars in sliding relation, and a longitudinal actuating member supported on said car for moving said cam lock and elements between said first and second position.

2. The invention in accordance with claim 1, including ground positioned cam arrangement engageable with said actuating member during movement of said car for moving the same longitudinally.

3. The invention in accordance with claim 2, including biasing means connected to said actuating member for returning said member to a position maintaining said cam lock and said cam elements in said first position.

4. The invention in accordance with claim 1, said cam elements each including an opening having a cam surface and said tension bars projecting through said openings.

5. The invention in accordance with claim 4, said tension rods each having a plurality of serrations providing teeth engageable with said cam surfaces at said openings.

6. The invention in accordance with claim 1, including biasing means connected to said cam locks and said cam elements for urging said locks to said first pivoted positions.

7. The invention in accordance with claim 1, including a bell crank lever pivotally connected to said cam lock for pivotal movement about a vertical axis, means pivotally connecting said bell crank lever to said cam lock for moving the same to said second position.

8. The invention in accordance with claim 7, said means connecting said bell crank lever to said actuating member including a flexible element.

9. The invention in accordance with claim 1, including locking cam surfaces on opposite sides of said longitudinal actuating member, said stop elements of opposite sides of said cam lock in said first position engaging said locking cam surfaces to lock said cam lock in said first position.

10. The invention in accordance with claim 9, said stop elements being disengaged from said locking cam surfaces of said actuating member during longitudinal movement of the same whereby said cam locks are moved to said second position.

* * * * *